United States Patent [19]

Takahashi

[11] Patent Number: 4,510,658

[45] Date of Patent: Apr. 16, 1985

[54] CLAMPING UNIT

[75] Inventor: Kihei Takahashi, Uozu, Japan

[73] Assignee: Yoshida Kogyo K. K., Tokyo, Japan

[21] Appl. No.: 393,477

[22] Filed: Jun. 29, 1982

[30] Foreign Application Priority Data

Jun. 29, 1981 [JP] Japan ..... 56-95213[U]

[51] Int. Cl.[3] ..... B23P 19/04

[52] U.S. Cl. ..... 29/33.2; 29/34 A; 29/767

[58] Field of Search ..... 29/33.2, 34 A, 766, 29/767, 768, 408, 769

[56] References Cited

U.S. PATENT DOCUMENTS

| | | | |
|---|---|---|---|
| 2,594,789 | 4/1952 | Morin | 29/33.2 |
| 2,631,638 | 3/1953 | Levine | 29/767 |
| 2,701,877 | 2/1955 | Morin | 29/33.2 |
| 2,714,210 | 8/1955 | Lange | 29/33.2 |
| 3,391,442 | 7/1968 | Thaeler | 29/408 |
| 3,714,698 | 2/1973 | Fukuroi | 29/408 |
| 3,812,571 | 5/1974 | Dori | 29/768 X |
| 4,137,621 | 2/1979 | Scagnelli | 29/33.2 X |
| 4,325,173 | 4/1982 | Kirii | 29/767 X |

FOREIGN PATENT DOCUMENTS

| | | | |
|---|---|---|---|
| 977527 | 11/1975 | Canada | 29/33.2 |
| 49-44244 | 11/1974 | Japan | 29/33.2 |
| 2022684 | 12/1979 | United Kingdom | 29/767 |
| 2074923 | 5/1980 | United Kingdom | 29/34 A |
| 2037878 | 7/1980 | United Kingdom | 29/767 |

*Primary Examiner*—William R. Briggs
*Assistant Examiner*—Glenn L. Webb
*Attorney, Agent, or Firm*—Hill, Van Santen, Steadman & Simpson

[57] ABSTRACT

A clamping unit has a pair of clamping jaws movable toward each other by manually operable threaded rods to clamp a slotted hollow body such as a separable bottom stop member for a separable slide fastener on a beaded edge positioned between the clamping jaws. A central presser presses the slotted hollow body against shoulders of the clamping jaws to shape the slotted hollow body. The clamping jaws and the presser are adjustably limited in their coacting movement so as to handle slotted hollow bodies of various sizes. The clamping jaws and the presser are spring-loaded so that they will be automatically retracted out of an operating position upon release.

4 Claims, 9 Drawing Figures

CLAMPING UNIT

BACKGROUND OF THE INVENTION

1. Field of the Invention

The present invention relates to a clamping unit for clamping a slotted hollow body on a beaded edge, and more particularly to a clamping unit for clamping a separable bottom stop member such as a pin or a box pin on a longitudinal beaded edge of a separable slide fastener stringer.

2. Prior Art

Separable slide fasteners include stringers each having on its end a separable bottom stop member such as a pin or a box pin clamped around a longitudinal beaded edge of the stringer. Such separable slide fasteners are mostly used in heavy-duty applications, such as on jumpers, sportswear, tents, or the like which are normally subject to high pulling forces. The clamped pin or box pin often tends to get deformed or torn off under rough usage of the slide fastener. The separable slide fastener having a broken pin or box pin needs to be repaired so as to be usable again.

Complete restoration of such damaged separable slide fasteners is time-consuming and costly as it requires careful hand labor in replacing useless parts with new components. The past trend of practice was therefore to throw away a broken separable slide fastener entirely and attach a new one in place of it, a procedure which is quite uneconomic.

One known device for mechanically clamping a separable bottom stop member on a slide fastener stringer is disclosed in Japanese Patent Publication No. 49-44244. The disclosed clamping device is, however, only capable of attaching parts designed to certain specifications, and hence is not reliable in coping with replacement of a wide variety of differently sized components.

SUMMARY OF THE INVENTION

A clamping unit for clamping a slotted hollow body on a beaded edge comprises a recessed frame, a pair of opposite clamping arms pivotably disposed in the recessed frame and having a pair of clamping jaws, respectively, for receiving the slotted hollow body with the beaded edge inserted therein, a pair of opposite threaded rods threadedly extending through the recessed frame respectively against the clamping arms and longitudinally movable to displace the clamping jaws toward or away from each other, and a pair of opposite adjustable stops mounted on the recessed frame for adjustably limiting the movement of the clamping jaws toward each other. The clamping jaws can clamp the slotted hollow body on the beaded edge when the jaws are forced toward each other by operating manual handles mounted on the threaded rods. The clamping jaws can accommodate therebetween slotted hollow bodies, such as pins or box pins of separable bottom stops, of various sizes. The clamping unit also includes a central presser movably supported on the recessed frame and having a presser edge located between the clamping arms for receiving thereon the slotted hollow body, and a central threaded rod threaded through the recessed frame against the central presser and longitudinally movable to displace the presser edge toward or away from the clamping jaws. When the slotted hollow body is clamped on the beaded edge by the clamping jaws, the presser edge is forced into contact with the slotted hollow body to press the latter against shoulders of the clamping jaws for thereby attaching the slotted hollow body securely to the beaded edge.

It is an object of the present invention to provide a clamping device for easily and reliably clamping slotted hollow parts on beaded edges.

Another object of the present invention is to provide a clamping unit for clamping slotted hollow components of various sizes on beaded edges.

Still another object of the present invention is to provide a clamping unit for clamping a separable bottom stop member such as a pin or a box pin on a longitudinal beaded edge of a separable slide fastener stringer.

A still further object of the present invention is to provide a portable, manually operable clamping unit.

Many other advantages, features and additional objects of the present invention will become manifest to those versed in the art upon making reference to the detailed description and the accompanying sheets of drawings in which a preferred embodiment incorporating the principles of the present invention is shown by way of illustrative example.

DETAILED DESCRIPTION

Figure 1:
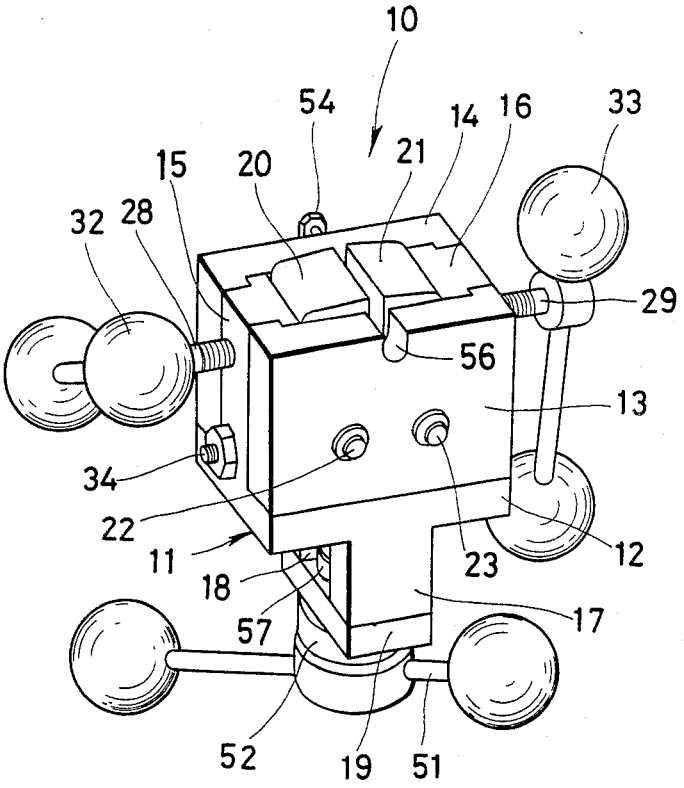
FIG. 1 is a perspective view of a clamping unit according to the present invention.
Figure 2:
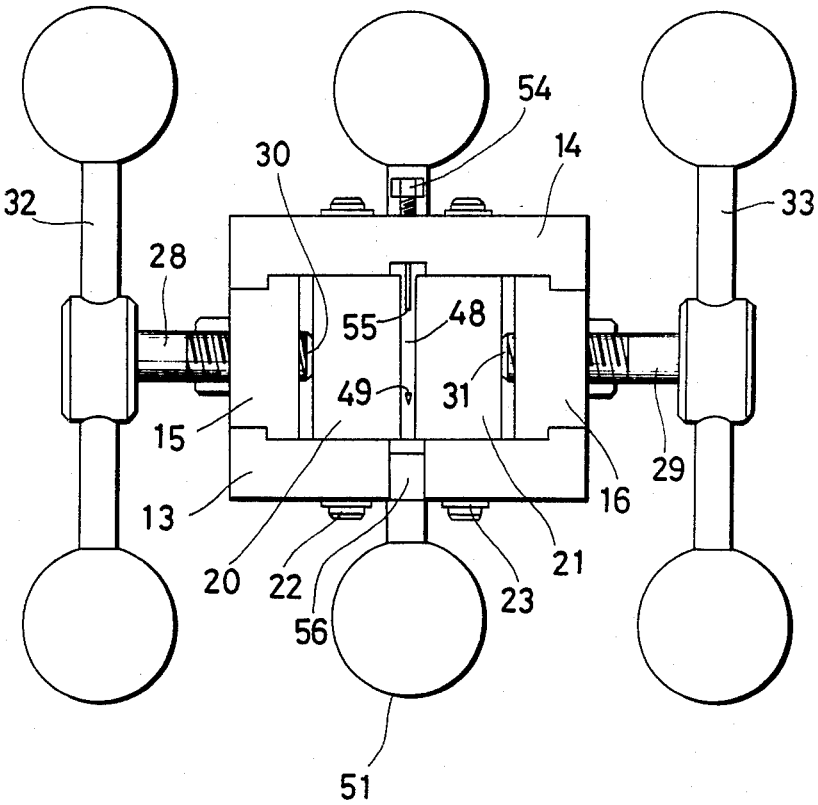
FIG. 2 is a plan view of the clamping unit shown in FIG. 1.
Figure 3:
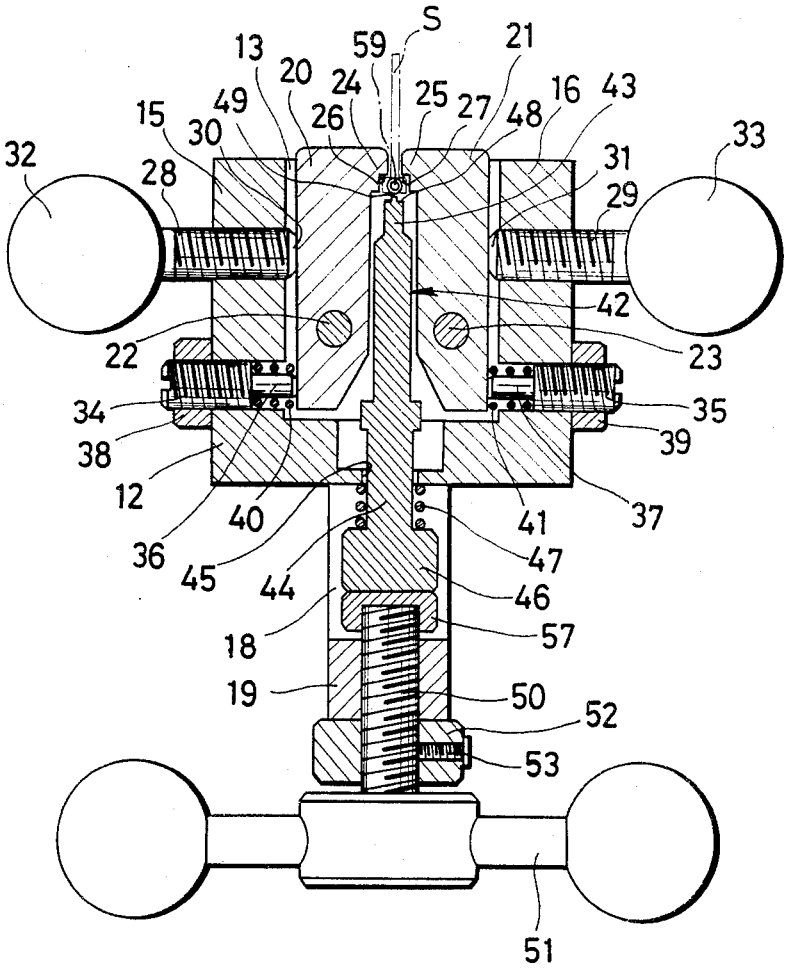
FIG. 3 is a cross-sectional view, with parts in side elevation, of the clamping unit of FIG. 1.

As shown in FIGS. 1 through 3, a clamping unit 10 according to the present invention comprises a recessed frame 11 including a bottom 12, a pair of front and rear walls 13, 14 mounted on the bottom 12 in spaced-apart relation, and a pair of spaced sidewalls 15, 16 extending upwardly from the bottom 12 and interposed between the front and rear walls 13, 14. A pair of spaced legs 17, 18 extends downwardly from the bottom 12 away from the front and rear walls 13, 14, respectively. The legs 17, 18 are interconnected by a connector plate 19 spaced from the bottom 12.

A pair of clamping arms 20, 21 is pivotably supported in the recessed frame 11 by a pair of pivot pins 22, 23, respectively, extending between the front and rear walls 13, 14. The clamping arms 20, 21 have upper portions slightly projecting upwardly out of the recessed frame 11 through an upper opening thereof. The clamping arms 20, 21 have a pair of upper clamping jaws 24, 25, respectively, including a pair of shoulders 26, 27, respectively, facing downwardly, as shown in FIG. 3.

The clamping unit 10 includes a pair of opposite threaded rods 28, 29 threadedly extending respectively through the sidewalls 15, 16 in alignment with each other. The threaded rods 28, 29 have a pair of ends 30, 31, respectively, which are held in frictional abutment against backs of the clamping arms 20, 21, respectively. As better illustrated in FIG. 2, the threaded rods 28, 29 are connected to a pair of manually operable handles 32, 33, respectively. The sidewalls 15, 16 (FIG. 3) support thereon a pair of adjustable stops 34, 35, respectively, each in the form of a setscrew threaded in the sidewalls. The adjustable stops 34, 35 include a pair of smaller-diameter rods 36, 37, respectively, engagable with the clamping arms 20, 21 at a position below the pivot pins 22, 23. The adjustable stops 34, 35 are securely mounted on the sidewalls 15, 16 by a pair of nuts 38, 39, respectively. The clamping jaws 24, 25 are normally urged to move away from each other under the force of a pair of compression coil springs 40, 41 disposed respectively around the smaller-diameter rods 36, 37 and acting between the clamping arms 20, 21 and the adjustable stops 34, 35.

Figure 4:
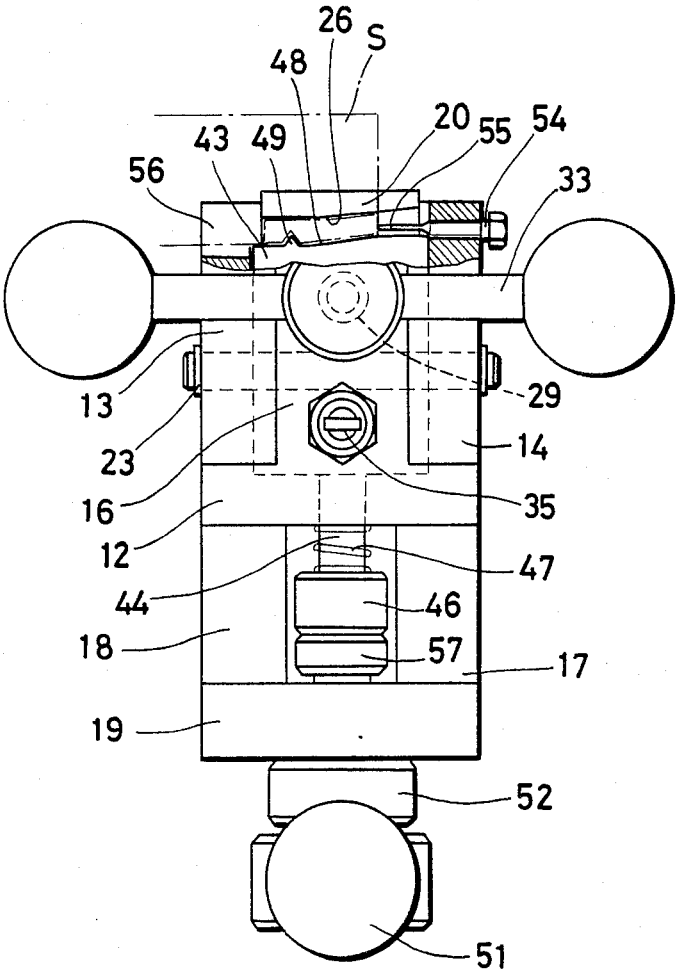
FIG. 4 is a front elevational view, partly in cross section, of the clamping unit of FIG. 1.

A central presser 42 is vertically movably supported on the recessed frame 11, and includes an upper end portion 43 positioned between the clamping arms 20, 21, an intermediate portion 44 extending through a hole 45 defined in the bottom 12, and a larger-diameter lower end portion 46. The central presser 42 is normally biased in a direction to move downwardly by a compression coil spring 47 coiled around the intermediate portion 44 and acting between the bottom 12 and the large-diameter lower end portion 46. The upper end portion 43 has an upper presser edge 48 facing upwardly toward the shoulders 26, 27 of the clamping jaws 24, 25, and a punch 49 (better shown in FIG. 4) projecting upwardly from the presser edge 48. As shown in FIG. 4, the presser edge 48 and the shoulder 26 (also the shoulder 27 through not shown in FIG. 4) are curved slightly upwardly toward the right.

A central threaded rod 50 threadedly extends vertically through the connector plate 19, as illustrated in FIG. 3, and has an upper end affixed to a cap 57 held in frictional engagement with the larger-diameter lower end portion 46. The central threaded rod 50 is connected to a manual handle 51. The central threaded rod 50 is limited in its upward movement by a central adjustable stop 52, in the form of a nut threaded therearound beneath the connector plate 19 and adjustably fastened to the central threaded rod 50 by a setscrew 53.

In FIGS. 2 and 4, a lateral adjustable stop 54 in the form of a screw extends threadedly through the rear wall 14 in the horizontal direction. The lateral adjustable stop 54 has an abutment bar 55 extending horizontally into the recessed frame 11 and positioned substantially centrally between the clamping jaws 24, 25. The abutment bar 55 is adjustably movable longitudinally in response to rotation of the adjustable stop or screw 54 about its own axis to position an end portion of a slide fastener stringer S, as shown in FIG. 4. As best shown in FIG. 1, the front wall 13 has in its upper edge an upwardly opening slot 56 aligned with the abutment bar 55 to receive therein an edge portion of the stringer S.

Figure 5:
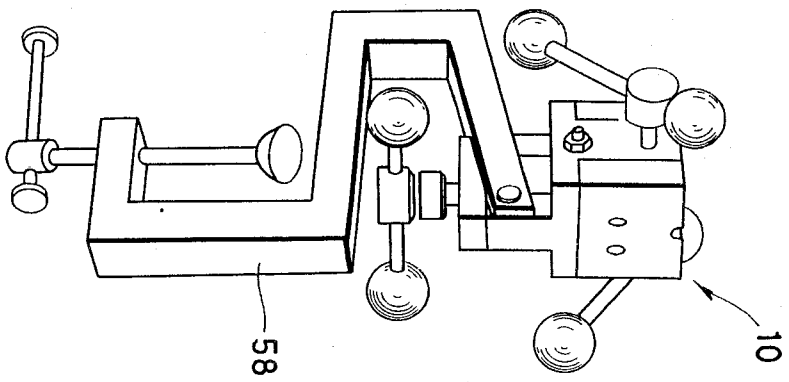
FIG. 5 is a perspective view of the clamping unit as mounted on a support.

As shown in FIG. 5, the clamping unit 10 is securely mounted on a support 58 which is fastened to a suitable worktable (not shown) during operation of the clamping unit 10.

Figure 6:
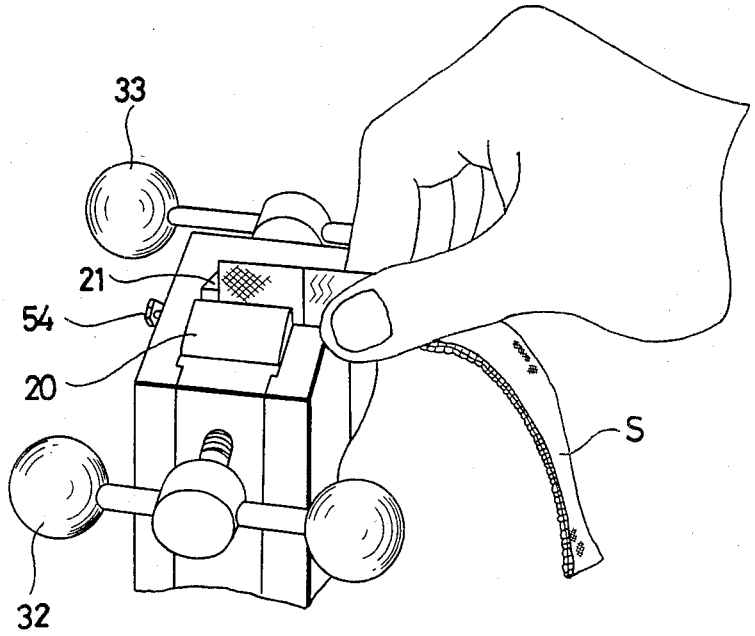
FIG. 6 is a fragmentary perspective view of the clamping unit with a slide fastener stringer inserted therein for attachment thereto of a separable bottom stop member.
Figure 7A:
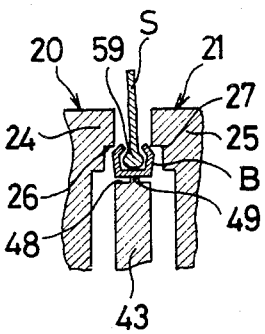
FIGS. 7A, 7B and 7C are fragmentary cross-sectional views showing progressive steps of clamping a separable bottom stop member on a slide fastener stringer.
Figure 7B:
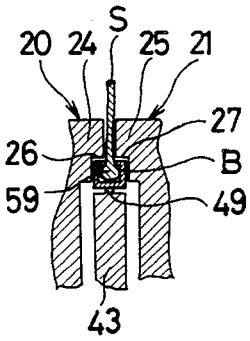
Figure 7C:
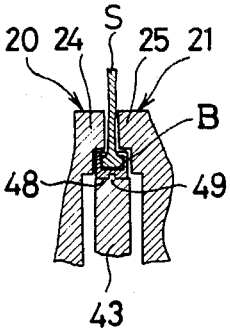

The clamping unit 10 thus constructed can be operated as follows: As shown in FIG. 6, a slide fastener stringer S is inserted between the clamping arms 20, 21 as they are widely open, and a longitudinal beaded edge 59 (FIG. 7) of the slide fastener stringer S is positioned between the clamping jaws 24, 25. The longitudinal beaded edge 59 is accommodated loosely in a separable bottom stop member B such as a pin or a box pin in the form of a slotted hollow body supported on the presser edge 48 of the central presser 42 with the presser in a lowered position as shown in FIG. 7A. At this time, the adjustable stop 54 is turned to adjust the projecting length of the abutment bar 55 so that a length of the stringer S which is equal to the length of the bottom stop member B will be present between the clamping jaws 24, 25. Then, the handles 32, 33 are operated to move the clamping jaws 24, 25 toward each other to cause the shoulders 26, 27 to engage and press upper clinching edges of the bottom stop member B toward each other until the clinching edges are forced into biting engagement with the stringer S, as shown in FIG. 7B. Thus, the bottom stop member B is laterally compressed on the beaded edge 59 of the stringer S by and between the clamping jaws 24, 25. Thereafter, the handle 51 is manipulated to raise the central presser 42 until the presser edge 48 is pressed against the bottom of the bottom stop member B. The bottom stop member B is now caused by the presser 42 to be shaped to a curved contour as defined by the curved shoulders 26, 27 and the presser edge 48, as shown in FIG. 4. At the same time, the punch 49 on the presser edge 48 forcibly penetrates the bottom stop member B, as shown in FIG. 7C, to thereby define a notch in the bottom stop member B. Such a notch will serve to receive a locking projection on another bottom stop member attached to a companion slide fastener stringer.

The movement of the clamping jaws 20, 21 toward each other, and the upward movement of the central presser 42 can be limited as desired by adjusting the adjustable stops 34, 35, and 52. Such adjustable control of limits to displacement of the clamping jaws 20, 21 and the central presser 42 allows various separable bottom stop members of different sizes to be handled by the clamping unit 10 without causing excessive compression of the bottom stop members. Furthermore, the springs 40, 41, and 47 enable the clamping arms 20, 21 and the presser 42 to be automatically withdrawn out of an operating position when the threaded rods 28, 29, and 50 are retracted.

The clamping unit 10 may be of a size small enough to be portable so that it can be carried to places where separable slide fasteners need to be repaired on site. The clamping unit 10 can be operated easily and reliably by an unskilled operator, and is an energy saver as it requires only manual power for operation.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A manually powered portable clamping apparatus for clamping a replacement slotted hollow body on a beaded edge, comprising:

(a) a recessed frame;

(b) a pair of opposite clamping arms pivotably disposed in said recessed frame and having a pair of clamping jaws at their upper end, respectively, for receiving the slotted hollow body with the beaded edge inserted therein;

(c) a pair of opposite manually movable threaded rods threaded through said recessed frame respectively against said clamping arms and longitudinally movable to reciprocate said clamping jaws toward and away from each other for forming and releasing the hollow body;

(d) a pair of opposite adjustable stops mounted on said recessed frame for adjustably limiting the movement of said clamping jaws toward each other;

(e) a central presser slidably supported on said recessed frame and having an upwardly facing presser edge located between said clamping arms below said jaws for receiving thereon the slotted hollow body;

(f) a manually movable central threaded rod threaded through said recessed frame against said central presser and vertically movable to move said presser upwardly toward or downwardly away from said clamping jaws, whereby the slotted hollow body supported on said raised presser edge can be clamped on the beaded edge by said clamping jaws as manually forced toward each other by said opposite threaded rods; and (g) three means respectively attached to each of said opposite threaded rods and said central threaded rod for enabling manual rotation of said threaded rods about their own axes to reshape said body.

2. A clamping apparatus according to claim 1, including a central adjustable stop disposed below said presser and threaded around said rotatable central threaded rod and carotatable therewith for adjustably limiting the upward movement of said central presser toward said claming jaws.

3. A clamping apparatus according to claim 1, including a longitudinally adjustable stop threadedly extending in said recessed frame and having an abutment bar interposed between said clamping jaws for being engaged by an end of the beaded edge, the adjustability being in a direction parallel to the beaded edge.

4. A clamping apparatus according to claim 1, wherein at least one of said three means comprises a manual handle.

* * * * *